United States Patent [19]

Liebler et al.

[11] 4,028,793

[45] June 14, 1977

[54] METHOD OF ASSEMBLING HELICAL RESISTOR

[75] Inventors: Marvin E. Liebler, Tonawanda; Eugene J. Lum, Williamsville, both of N.Y.

[73] Assignee: Westinghouse Electric Corporation, Pittsburgh, Pa.

[22] Filed: Sept. 13, 1976

[21] Appl. No.: 722,834

Related U.S. Application Data

[62] Division of Ser. No. 591,246, June 27, 1975, Pat. No. 4,001,761.

[52] U.S. Cl. ..... 29/618; 29/469; 228/173

[51] Int. Cl.[2] ..... H01C 17/04

[58] Field of Search ..... 29/618, 614, 615, 469, 29/616, 610 R; 228/173 E; 338/58, 267, 270, 278, 282, 286, 304, 305, 315, 321

[56] References Cited

UNITED STATES PATENTS

| | | | |
|---|---|---|---|
| 2,502,044 | 3/1950 | Isaacson | 338/305 X |
| 2,533,876 | 12/1950 | Cerny | 29/618 X |
| 2,560,690 | 7/1951 | Griffes et al. | 338/278 X |
| 3,200,856 | 8/1965 | Bex et al. | 29/618 X |

FOREIGN PATENTS OR APPLICATIONS

| | | | |
|---|---|---|---|
| 874,703 | 5/1942 | France | 338/278 |
| 1,929,583 | 12/1969 | Germany | 29/618 |

*Primary Examiner*—Victor A. DiPalma
*Attorney, Agent, or Firm*—R. E. Converse, Jr.

[57] ABSTRACT

A power resistor including a resistance element of metal ribbon formed into an edgewound helix, and an internal three-point support structure axially disposed within the interior of the helix. The support structure includes three insulating assemblies each having a plurality of insulators secured by longitudinal compression springs to a support bar. The support structure also includes a pair of spreaders located at opposite ends of the helix, each having three radially extending arms. Assembly of the resistor includes the steps of inserting the insulating assemblies into the interior of the helix, radially spreading the insulating assemblies against the interior of the helix, and welding the ends of the support bars to the extending arms of the spreaders.

6 Claims, 19 Drawing Figures

METHOD OF ASSEMBLING HELICAL RESISTOR

This is a division of application Ser. No. 591,246 filed June 27, 1975, now U.S. Pat. No. 4,001,761.

BACKGROUND OF THE INVENTION

1. Field of the Invention

The invention relates to electrical resistors and more particularly to large power resistors employing a resistance element wound in the shape of a helix.

2. Description of the Prior Art

Large power resistors are widely used in the grounding of the neutral lead of three phase power systems, dynamic breaking, wound rotor motor control, and other industrial applications. It is desirable to attain a high volume efficiency, that is, a large mass of resistance material per unit volume. One way of accomplishing this is to configure the current-carrying portion of the resistor as an edge-wound helix of metal ribbon. For many popular ratings the helix does not have sufficient mechanical stability to be self-supporting and requires a support structure. Some prior art resistors employed a three point support structure inside the helix. Three U-channels supported toothed insulators, the insulators being fixed to the channels with an asbestos strip impregnated with a supersaturated sodium silicate solution. The channels were fixed and spaced by internal circular supports welded to the channels. After construction of the support assembly, the previously wound helix was screwed onto the support assembly. This configuration provided good heat dissipation because of the wide area for incoming cooler air at the bottom of the helix. However, the fixed internal support was expensive to manufacture due to the high cost of the many welding operations on the internal support. Since the helix was wound onto the support assembly after construction relatively large clearances were required, producing a loose ribbon-to-insulator fit. In addition the use of the asbestos in the resistor presented a possible health hazard to assembly workers.

Another type of resistor employed an internal support formed from a single steel bar having a rectangular cross section. Insulators were fixed to the two narrow-dimensioned sides of the bar with asbestos impregnated with supersaturated sodium silicate solution. After construction of this subassembly the previously wound helix was screwed onto the support assembly, thereby providing a two-point support structure. The manufacturing cost of this resistor was lower than the previously described three-point support resistor. However, the same problem of a loose fitting helix was present due to the necessity to screw the helix onto the support structure after assembly of the support structure. The health hazard from use of the asbestos was also present. In addition the unit exhibited limited mechanical stability in response to forces applied perpendicular to the plane of the longer cross sectional dimension of the support bar. Increasingly, specifications for resistors include requirements for mechanical stability in all directions in order to resist seismic forces.

Another type of resistor employed a pair of rectangularly sectioned steel bars supporting toothed insulators. The bars were inserted into the helix, laterally spread apart to force the toothed insulators into contact with the interior of the helix, and spot welded to permanently maintain this position. This resistor had the advantage of low manufacturing cost and a tight fit between the insulators and the interior of the helix. However, the large toothed insulators required by a two-point support restricted air flow, resulting in poor heat dissipation and lower current rating. In addition, the problem of limited stability when subjected to forces perpendicular to the plane of the longer cross sectional support dimension remained. It is desirable to provide a helical wound power resistor having a three-point support for good heat dissipation and less restricted air flow, a tight ribbon-to-insulator fit, a minimum of welding operations on the internal support prior to assembly the resistor, elimination of asbestos and adhesive material, good mechanical resistance to forces applied in all directions, and a low manufacturing cost.

SUMMARY OF THE INVENTION

In accordance with one embodiment of the invention, a resistor is provided including a helical resistance element having two ends. The resistance element includes terminal means electrically connected to each of the ends. An internal support structure is axially disposed within the interior of the resistance element and includes three insulating assemblies, each having a plurality of insulators seated upon a support bar, and secured thereto by a spring member. A pair of spreaders is interiorly disposed at each end of the resistance element and includes three radially extending members, each member carrying one end of the support bars so that the insulators are rigidly seated against the interior of the resistance element.

BRIEF DESCRIPTION OF THE DRAWINGS

For better understanding of the nature of the invention, reference may be had to the following detailed description, taken in conjunction with the accompanying drawings, in which.

DESCRIPTION OF THE PREFERRED EMBODIMENT

Figure 1:
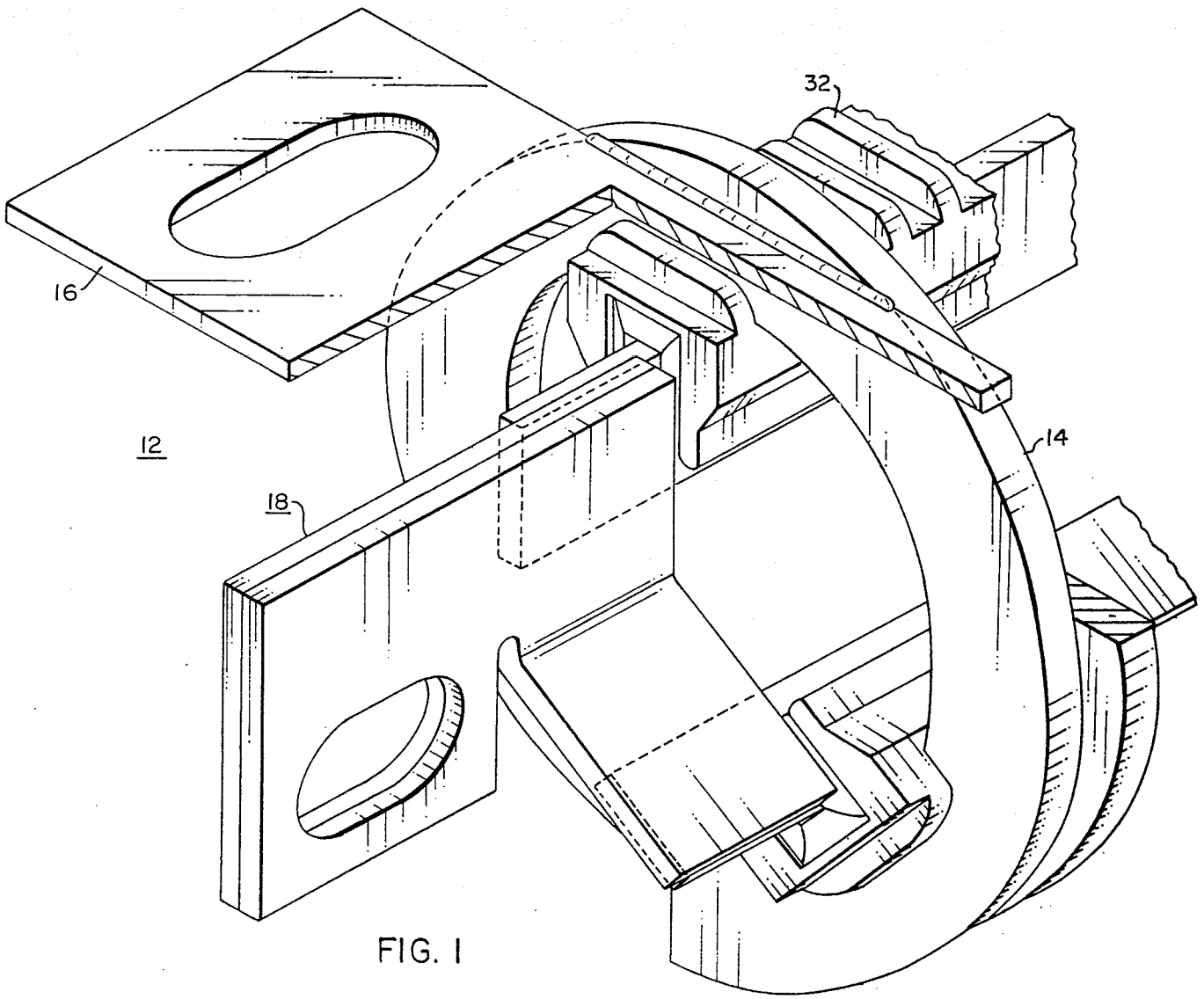
FIG. 1 is a perspective view of a resistor constructed in accordance with the principles of the present invention.

Throughout the drawings corresponding reference characters refer to corresponding parts.

Figure 4C:
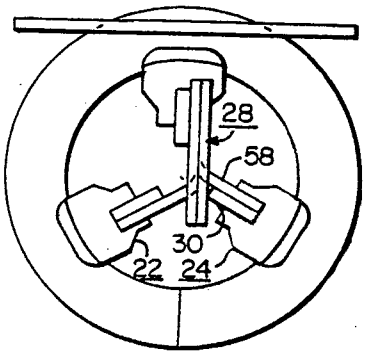
FIG. 4C is a right end view of the resistor shown in FIGS. 4A and 4B.
Figure 4B:
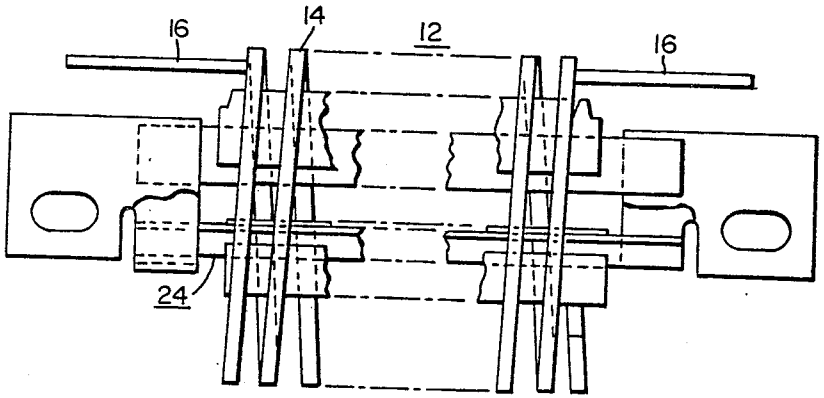
FIG. 4B is a side view of the resistor shown in FIG. 4A.
Figure 4A:
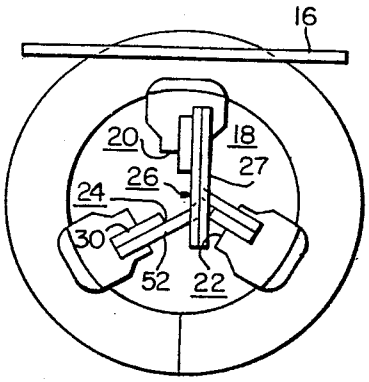
FIG. 4A is a left end view of the resistor of FIG. 1 shown completely assembled.

Referring now to the drawings, in FIG. 1 there is shown a power resistor 12 constructed in accordance the principles of the present invention. The resistor 12 includes a resistance element 14 of annealed stainless steel ribbon, edge-wound into the shape of a helix. Terminals 16 are welded to each end of the resistance element 14 and are used to electrically connect the resistor 12 into an external circuit. The resistance element 14 is supported by a three-point internal support assembly 18, shown more clearly in FIGS. 4A and 4C. The internal support assembly 18 comprises three insulating bar assemblies 20, 22, 24 and a pair of spreaders 26, 28.

Figure 5:
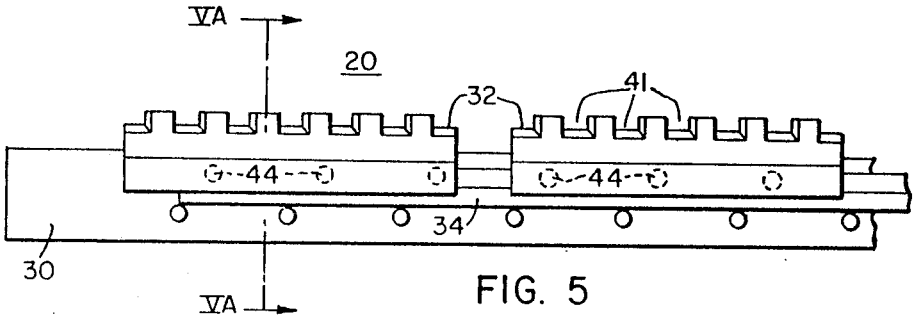
FIG. 5 is a detail side view of the insulating bar assembly shown in FIGS. 2A through 4C.
Figure 5A:
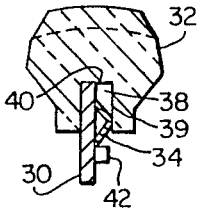
FIG. 5A is a sectional view of the insulating bar assembly taken along the line V—V of FIG. 5.
Figure 10:
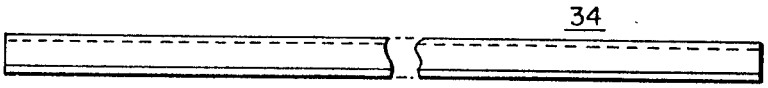
FIG. 10 is a side view of the seating spring of the insulating bar assembly shown in FIGS. 2A–5.
Figure 11:
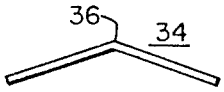
FIG. 11 is an end view of the seating spring shown in FIG. 10.

Each insulating bar assembly, one of which is shown more clearly in FIG. 5, includes a support bar 30 of stainless steel and a plurality of porcelain insulators 32. The insulators 32 are firmly seated upon the support bar 30 by a seating spring 34. As can be seen in FIGS. 10 and 11, the seating spring 34 includes a longitudinal crease 36 producing a shallow angle. Each porcelain insulator 32 includes a longitudinal slot 38 for receiving the support bar 30 and a series of transverse grooves 41. As can be seen in FIG. 5A, the seating spring 34 is positioned between the upper edge 40 of the slot 38 and a series of half-shear projections 42 punched into the support bar 30. A series of holes 44, punched into the support bar at the same time as the half-shear projections 42, equalizes the stress within the bar 30 produced by the punching operation and prevents edgewise bowing.

Figure 7:
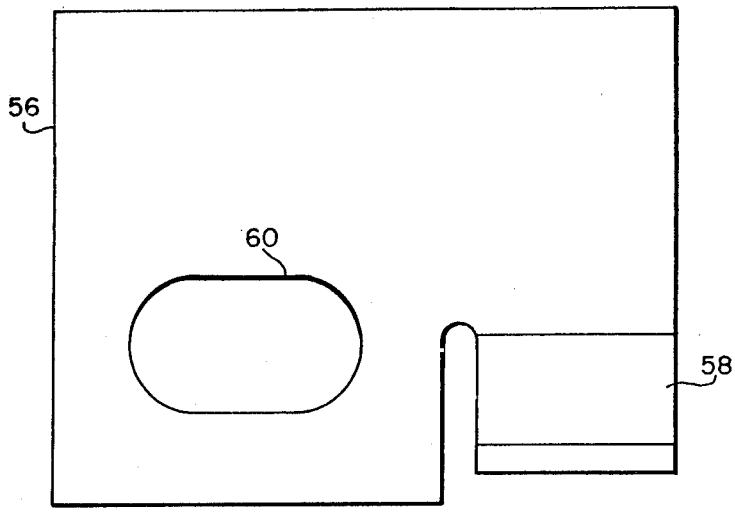
FIG. 7 is a side view of the right side element shown in FIG. 6.
Figure 6:
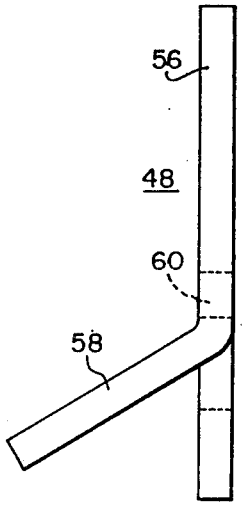
FIG. 6 is an end view of the right side element of one of the spreaders shown in the FIGS. 2B, 2D, 3A, 3C, 4A, and 4C.
Figure 8:
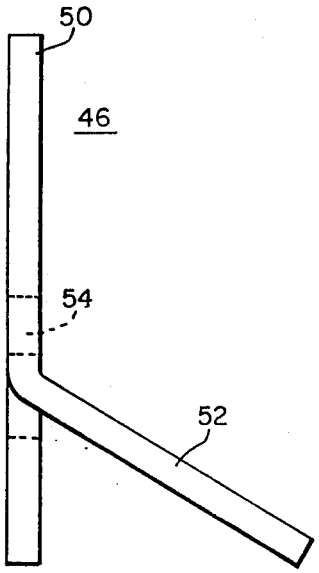
FIG. 8 is an end view of the left side element of one of the spreaders shown in FIGS. 2B, 2D, 3A, 3B, 4A, and 4C.
Figure 9:
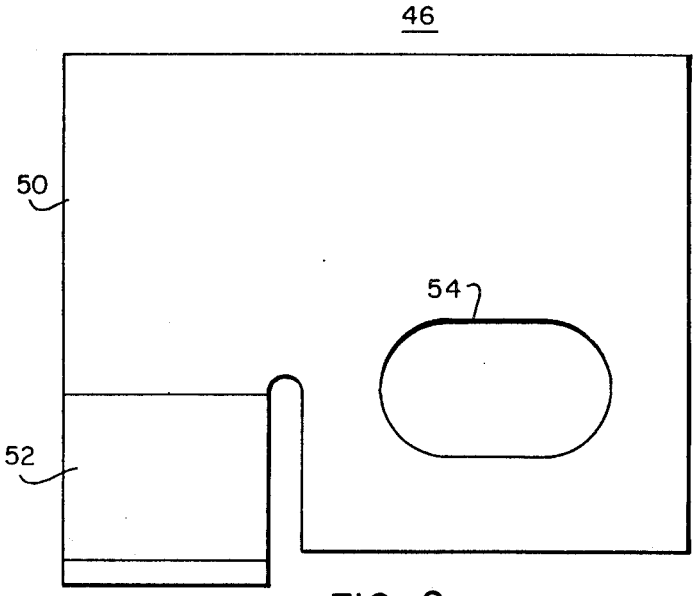
FIG. 9 is a side view of the left side element shown in FIG. 8.

The three insulating bar assemblies 20, 22 and 24 are supported by the spreaders 26 and 28, each of which includes a left side element 46, shown in FIGS. 8 and 9, and a right side element 48 shown in FIGS. 6 and 7. The left side element 46 includes a main portion 50, an angularly projecting leg 52 and a mounting hole 54. Similarly, the right side element 48 includes a main portion 56, an angularly projecting leg 58, and a mounting hole 60. As can be seen in FIGS. 2B, 2D, 3A, 4A, and 4C, the elements 46 and 48 are fastened by a plurality of welds to form the spreaders 26 and 28 having three radially extending arms. The insulating bar assemblies 20, 22, and 24 are welded in a manner to be hereinafter described to the spreaders 26 and 28 to form the internal support assembly 18 and rigidly support the resistance element helix 14. The mounting holes 54, 60 provides means for mechanically securing the resistor 12 in the manner desired.

Construction of the resistor 12 is initiated by winding stainless steel ribbon into a long helix. The helix is cut to the length desired to form the resistance element 14 and the terminals 16 welded to the ends thereof. Next the left side elements 46 and right side elements 48 are spot welded together to form the spreaders 26 and 28. Note that the legs 52 and 58 are of unequal length. Thus, the spreaders 26 and 28 are asymmetrical.

Using the half-shear projections 42, the seating spring 34 is positioned against the bar 30 of the top insulating bar assembly 20. The desired number of insulators 32 are then seated upon the bar 30 to form the insulating bar assembly 20. The spring 34 bears against the bar 30 and the side 39 of the insulator slots 38, thereby firmly securing the insulators 32 to the bar 30. In a similar manner insulators 32 are seated upon bars 30 and springs 34 to form the insulating bar assemblies 22 and 24.

Figure 2A:
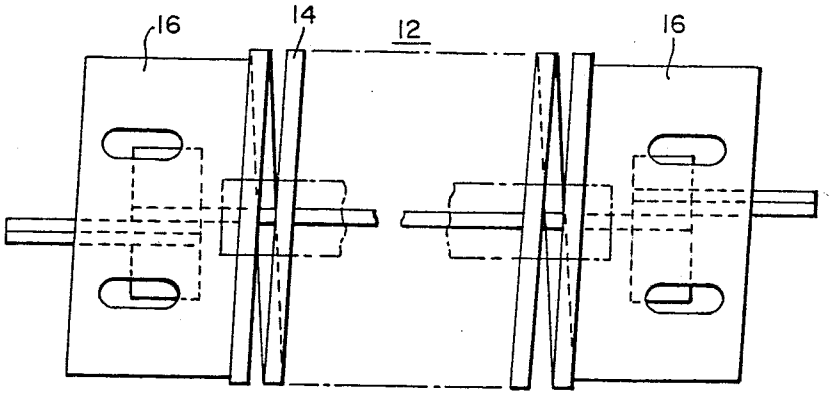
FIG. 2A is a top view of the resistor of FIG. 1, shown partially assembled.
Figure 2C:
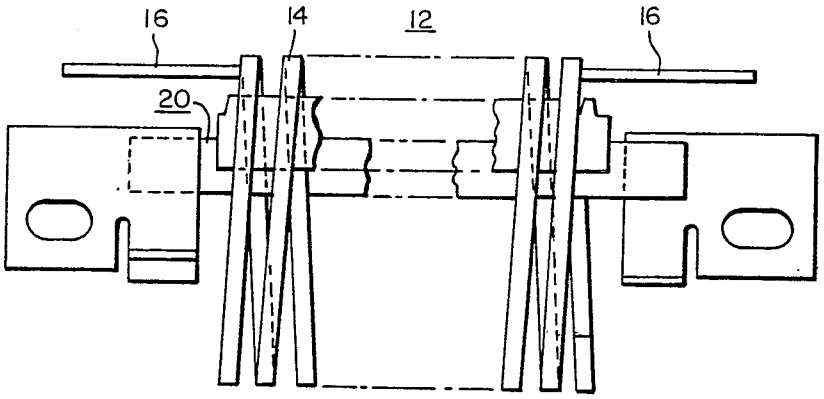
FIG. 2C is a side view of the partially assembled resistor shown in FIGS. 2A and 2B.
Figure 2B:
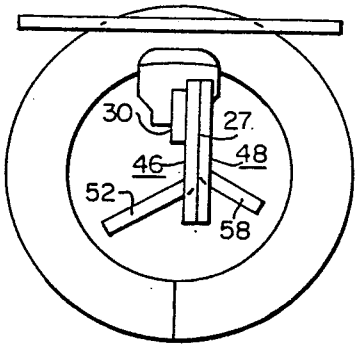
FIG. 2B is a left end view of the partially assembled resistor shown in FIG. 2A.
Figure 2D:
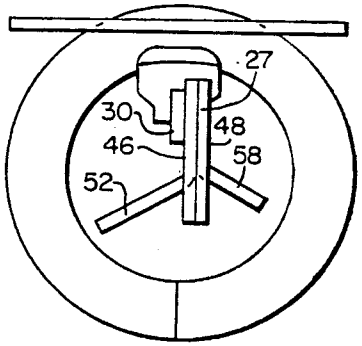
FIG. 2D is a right end view of the partially assembled resistor shown in FIGS. 2A, 2B and 2C.
Figure 3C:
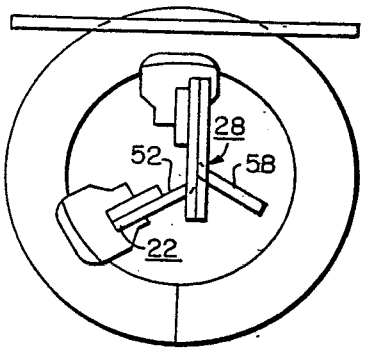
FIG. 3C is a right end view of the partially assembled resistor shown in FIGS. 3A and 3B.
Figure 3B:
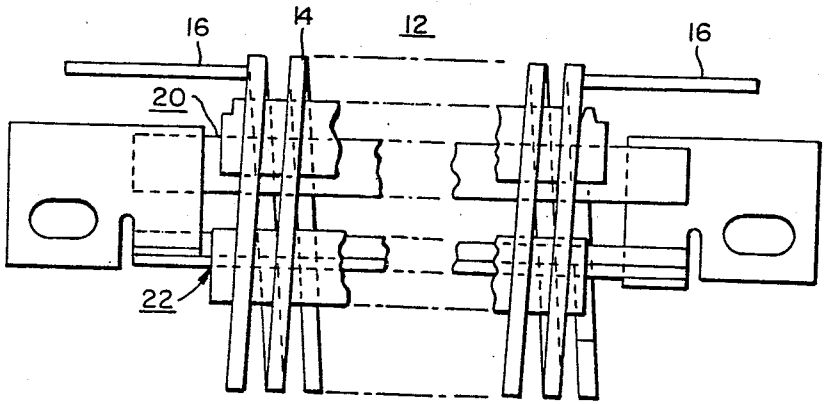
FIG. 3B is a side view of the partially assembled resistor shown in FIG. 3A.
Figure 3A:
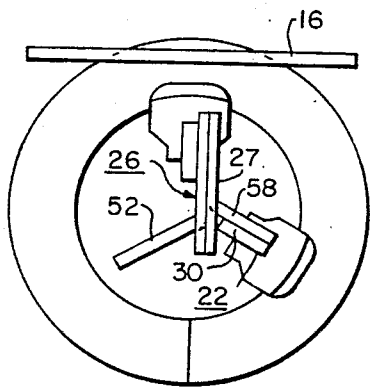
FIG. 3A is a left end view of the resistor of FIG. 1 shown in a stage of assembly more advanced than that shown in FIGS. 2A through 2D.

The support bar 30 of the top insulating bar assembly 20 is then welded to the upper arms 27 of the spreaders 26 and 28 as shown in FIGS. 2B and 2D, with the ends of the support bar 30 positioned on the side of upper arms 27 closest to the long leg 52. The top insulating bar assembly 20 along with the attached spreaders 26 and 28 is inserted into the interior of the resistance element helix 14. The turns of the helix 14 are seated in the transverse grooves 41 of the insulators 32. Next the insulating bar assembly 22 is inserted into the interior of the resistance 14 helix and the grooves 41 of the insulating bar assembly 22 positioned so as to support the turns of the helix 14. The bar 30 of the insulating bar assembly 22 is then welded to the upper side of the long leg 52 and the lower side of the short leg 58 of the spreaders 26 and 28 as shown in FIGS. 3A and 3C. Finally, the third insulating bar assembly 24 is inserted into the interior of the helix 14. After positioning the insulators 32 along the bar 30 so as to properly receive the turns of the helix 14 in the grooves 41 the insulating bar assembly 24 is spread radially outward along the remaining legs 52 and 58 to rigidly support the resistance element 14. The ends of the bar 30 of the insulating bar assembly 24 are then welded to the upper side of the long leg 52 of the spreader 26 (FIG. 4A) and the lower side of the short leg 58 of the spreader 28 (FIG. 4C) thus forming the rigid three point internal support assembly 18.

Note that the unequal radial lengths of the three members carrying the insulating support assemblies 20, 22 and 24 produce asymmetrical spreaders 26 and 28 having intersection points of the three members which are spaced away from the axis of the resistance element helix 14. This arrangement simplifies assembly and provides for mounting of the insulating bar assemblies 20, 22 and 24 so that sufficient metal-to-metal clearance is provided between the support bars 30 and the inside edge of the resistance element helix 14, thereby maintaining the required degree of insulating capability.

As can be seen, the seating springs 34 allow the insulators 32 to be easily positioned upon the support bars 30 and remain securely in place throughout the assembly process without the use of asbestos or adhesive material. This significantly reduces the assembly time of the resistor since no drying time is required to set the adhesive, thereby reducing assembly cost. In addition, the elimination of asbestos from the resistor assembly process removes the health hazard to workers which is associated with this material. Provision of a three-point interior support for the resistance element helix 14 allows a smaller cross section of insulator to be used, thereby providing less restricted air flow and good heat dissipation. The three-point support provides a rigid structure and good mechanical resistance to forces applied from any direction, thereby fulfilling requirements of seismic specifications. The large inside diameter of the resistance element helix 14 allows a large ribbon cross section, thereby permitting a relatively large maximum current. This eliminates the extensive paralleling of resistor units which is required to obtain the same current capability with a small helix inside diameter.

The assembly method described minimizes welding operations on the internal support prior to assembling the resistor, thereby reducing the cost. In addition, the method provides for mounting of the interior support assembly 18 within the resistance element helix 14 without requiring the helix 14 to be screwed onto the insulators 32. Thus, a very tight ribbon-to-insulator fit is obtained, thereby providing good resistance to mechanical and electrodynamic stress imposed during high current operation.

From the foregoing it can be seen that the invention provides a resistor exhibiting improved performance and lower cost. Since numerous changes may be made in the above described construction and different embodiments of the invention may be made without departing from the spirit and scope thereof, it is intended that all subject matter contained in the foregoing description or shown in the accompanying drawings shall be interpreted as illustrative and not in a limiting sense.

We claim:

1. A method for assembling a resistor having a helical resistance element and an internal insulating assembly supporting said resistance element at a plurality of points, comprising the steps of:

forming a ribbon of resistance material into an edge-wound helix;

welding each end of a first support bar to corresponding first arms of first and second asymmetrical spreaders each having a plurality of radially extending arms;

affixing insulating means to said first support bar;

affixing insulating means to a plurality of additional support bars;

placing a first subassembly comprising said first support bar, said insulating means, and said spreader members into the interior of said helix;

inserting additional subassemblies comprising all but one of said additional support bars and insulating means into the interior of said helix and welding each end of said all but one additional support bars to corresponding radially extending arms of said first and second spreaders;

inserting a last subassembly comprising the last of said additional support bars and said insulating means into the interior said helix;

spreading said last subassembly radially outward along corresponding empty arms of said first and second spreader members against the interior of said helix to firmly position each of said subassemblies against the interior of said helix; and welding each end of said last support bar to said corresponding empty radially extending arms of said spreaders.

2. A method for assembling a resistor as recited in claim 1 wherein each subassembly support bar end is attached to one of said spreader arms at unequal distances from the axis of said helix.

3. A method for assembling a resistor as recited in claim 2 wherein said resistor comprises three of said subassemblies and each of said spreaders comprises three radially extending arms.

4. A method for assembling a resistor as recited in claim 3 wherein at each spreader two of said support bar ends are attached to adjacent sides of said radially extending arms.

5. A method for assembling a resistor as recited in claim 4 wherein at each of said spreaders the third one of said support bar ends is attached to the shortest radially extending arms.

6. A method for assembling a resistor as recited in claim 1 wherein said insulating means affixing steps comprises the steps of:

placing a longitudinal compression spring against said support bars, and placing insulating means having a longitudinal slot formed therein upon said support bars so that said compression spring is seated between said support bars and the walls of said longitudinal slot.

* * * * *